US008458933B2

(12) United States Patent
Tahan

(10) Patent No.: US 8,458,933 B2
(45) Date of Patent: Jun. 11, 2013

(54) SPORTS MEMORABILIA DISPLAY

(76) Inventor: George P. Tahan, Arlington, MA (US)

( * ) Notice: Subject to any disclaimer, the term of this patent is extended or adjusted under 35 U.S.C. 154(b) by 0 days.

(21) Appl. No.: 10/117,980

(22) Filed: Apr. 5, 2002

(65) Prior Publication Data

US 2003/0188468 A1 Oct. 9, 2003

(51) Int. Cl.
*G09F 1/08* (2006.01)

(52) U.S. Cl.
USPC ..... 40/538; 211/14; 206/315.9

(58) Field of Classification Search
USPC ..... 40/538, 661, 800, 358, 727, 320; 428/13, 428/542.4; 211/14, 134; 206/315.9, 524.8, 206/776; D6/303, 345, 351, 358, 450, 451, D6/563, 574, 567; 297/219.1; 5/653, 656
See application file for complete search history.

(56) References Cited

U.S. PATENT DOCUMENTS

| | | | | | |
|---|---|---|---|---|---|
| 544,305 | A | * | 8/1895 | Jones | 446/482 |
| D46,241 | S | * | 8/1914 | Allison | D21/627 |
| 1,442,343 | A | * | 1/1923 | Hueter | 446/482 |
| 1,854,663 | A | * | 4/1932 | Nebel | 446/109 |
| D164,161 | S | * | 8/1951 | Fischer | D21/632 |
| 3,079,198 | A | * | 2/1963 | Morgan et al. | 40/320 |
| 3,702,034 | A | * | 11/1972 | Pfeiffer | 40/320 |
| 4,925,241 | A | * | 5/1990 | Geraci | 297/229 |
| 4,955,485 | A | | 9/1990 | Alton | |
| 5,000,514 | A | * | 3/1991 | Hanson | 297/440.13 |
| 5,082,110 | A | * | 1/1992 | Hager | 206/232 |
| D325,760 | S | * | 4/1992 | Hoglund | D21/627 |
| 5,165,538 | A | | 11/1992 | Peters | |
| D346,520 | S | | 5/1994 | Barfield | |
| D352,001 | S | | 11/1994 | Hsieh | |
| D352,176 | S | | 11/1994 | McMillan | |
| D353,283 | S | | 12/1994 | Ford | |
| 5,377,828 | A | | 1/1995 | Jaroshewich | |
| 5,377,829 | A | | 1/1995 | Bahl | |
| D367,561 | S | | 3/1996 | Kwan | |
| D386,533 | S | | 11/1997 | Kvoka | |
| D391,795 | S | * | 3/1998 | Pellerin | D6/574 |
| 5,791,075 | A | * | 8/1998 | Martell | 40/1 |
| D409,415 | S | | 5/1999 | Elmer et al. | |
| 5,988,401 | A | | 11/1999 | Gardner et al. | |
| 6,016,910 | A | | 1/2000 | Rodearmel | |
| D419,813 | S | * | 2/2000 | Perrin | D6/570 |
| 6,026,969 | A | * | 2/2000 | Okui | 211/14 |
| 6,029,826 | A | | 2/2000 | Clay | |
| D434,577 | S | * | 12/2000 | Marek | D6/376 |

(Continued)

OTHER PUBLICATIONS

Unrestored-Authenthic Wrigley Field Artifacts, 130s Wooden Bleacher Sections www.Collectible Stadium Seats.com, http://hometown.aol.com/rlc hl ea/seat.html, p. 2, Jan. 21, 2007.*

(Continued)

*Primary Examiner* — Casandra Davis
(74) *Attorney, Agent, or Firm* — Hamilton, Brook, Smith & Reynolds, P.C.

(57) ABSTRACT

A display for an article of sports memorabilia, where the display is configured to resemble a seat from a sports venue at a substantially reduced scale. The display includes a generally horizontal shelf member for receiving an article of sports memorabilia, and a support structure for supporting the shelf member at a raised elevation. The display is particularly useful for displaying various hems of sports memorabilia and other similar collectibles, including balls, pucks, and sports equipment.

4 Claims, 10 Drawing Sheets

U.S. PATENT DOCUMENTS

| | | | | |
|---|---|---|---|---|
| 6,199,804 | B1 | 3/2001 | Donofrio, Jr. | |
| 6,220,441 | B1 | 4/2001 | Cook | |
| D450,484 | S | 11/2001 | Tamburello | |
| 6,517,406 | B1 * | 2/2003 | Cash | 446/97 |
| 6,655,056 | B1 * | 12/2003 | Wolf et al. | 40/124 |

OTHER PUBLICATIONS

50th aniversary racing seat cell phone holder, http://images.google.com/imgurl-http:www.godsilperformance.com/corvette-parts, Jan. 21, 2007.*

* cited by examiner

SPORTS MEMORABILIA DISPLAY

BACKGROUND OF THE INVENTION

The collection of nostalgia items in general, and sports memorabilia in particular, has grown in recent years from a small cottage industry for hobbyists into a multi-million dollar business. There has been a recognized need for a suitable means to display various articles of sports memorabilia, which can include, for instance, balls, pucks, sports equipment, uniforms, autographs, trading cards, pieces of playing surfaces and venues, and other items associated with athletic competition.

In the case of balls and pucks, for instance, a number of display devices have been developed, the display devices generally including a base member which rests stably on a surface, and supports the article at a raised elevation so that it may be easily viewed. Frequently, these devices also include a transparent case which encloses the memorabilia article to protect the article from environmental conditions.

One problem with these display devices is that they are themselves relatively generic and utilitarian, and do not add to the asthetic quality of the viewer's experience. Various attempts have been made to overcome this problem, such as displaying the article in conjunction with a photograph, description, or other sports related items. Also, display devices have been made where the base of the display is made in the shape of a playing surface, or a baseball glove.

SUMMARY OF THE INVENTION

The present invention is directed to a display for an article of sports memorabilia, where the display is configured to resemble a seat from a sports venue at a substantially reduced scale. The display includes a generally horizontal shelf member for receiving an article of sports memorabilia, and support means for supporting the shelf member at a raised elevation. In a preferred embodiment, the support means comprise a pair of generally vertical support frames in a parallel configuration. The shelf member is secured at opposite sides to each of the frames, preferably so that the shelf member can pivot from a substantially horizontal position to an upright position when the display is not in use. The shelf member is configured to resemble the seat portion of a sports venue spectator chair, and is typically comprised of a series of parallel slats which extend across the width of the seat. The display preferably also includes at least one back support member, configured to resemble the seat back of a stadium seat, which can be one or more slats extending between the upper portions of the vertical support members.

The display as a whole is configured to replicate the characteristic appearance of a seat from a sports venue, such as a stadium or indoor arena, but at a substantially reduced scale. In general, the seat is sized so that an article of sports memorabilia can be easily supported on the top surface of the horizontal shelf member. In a preferred embodiment, the size of the display is also roughly consonant with the size of the article intended to be displayed. For instance, where the top surface of the shelf member has one or more dimensions, (such as a length, width, or diameter), then the size of at least one of these dimensions is preferably approximately matched to a dimension of the article of sports memorabilia. If the article is a ball, for example, then preferably at least one of the length or width of a rectangular-shaped shelf is approximately matched to the diameter of the ball.

The display can be used to display numerous articles of sports memorabilia, or other similar collectibles, including balls, pucks, sports equipment, hats, uniforms, trading cards, programs, etc. According to one aspect, the display can be configured to resemble a seat from a particular sporting venue, where the venue is itself associated with the article to be displayed. For example, the display could be configured to resemble a seat from a famous baseball stadium and the article of sports memorabilia could be an autographed baseball from an athlete who plays or once played in that stadium. For even greater accuracy, the miniature display could be made to have the same color scheme and/or other indicia (e.g. seat number) as found in the actual seat after which it is modeled. In other embodiments, the display could have the color scheme associated with a particular team, or could display other indicia associated with a particular team or athlete, such as a name, number, or logo.

In certain embodiments, the display can include a generally transparent case for holding an article of sports memorabilia, where the case is supported on the top surface of the generally horizontal shelf member. The case can optionally be secured to the shelf, vertical supports, and/or back support. In another aspect, a generally transparent case can be configured to fit over the entire display to provide additional protection to the article of sports memorabilia.

According to another aspect, a series of adjacent displays can be joined together to resemble a row of seats from a sporting venue. Typically, when the seats are joined in a row configuration, the adjacent shelf members are joined to and share a common support member.

According to another aspect, the present invention is directed to a method for displaying an article of sports memorabilia, the method comprising the steps of selecting a seat from a sports venue, and producing a replica of the seat at a substantially reduced scale, the replica including a generally horizontal shelf member for receiving an article of sports memorabilia and support means for supporting the shelf member at a raised elevation.

In still other aspects, the present invention relates to methods for manufacturing a sports memorabilia display, and a kit for manufacturing a sports memorabilia display, where the display resembles the seat from a sports venue at a substantially reduced scale.

The present invention advantageously provides a display for a sports memorabilia item where the display itself evokes the look and feel of a an actual seat from a sports venue. Stadium seats are generally mass-produced at relatively low cost, and are characterized by a relatively simple and highly durable construction. For example, in most "old time" stadiums and arenas, particularly those venues build before about 1950, the spectator seats generally include a pair of cast-iron or steel vertical support frames which provide mechanical support to the chair and can double as armrests, a seat comprised of series of parallel wooden slats which can pivot to an upright position when the chair is not in use, and a chair back which is typically also comprised of a plurality of wooden slats extending between the upper portions of the vertical support frames. This same basic structure is also found in most modem stadiums, as well, although these newer seats frequently incorporate more modern materials, such as plastics, into the underlying seat design.

Despite the utilitarian origins these stadium seats, collectors are nevertheless discovering a certain intrinsic value in these seats, particularly in the older seats from now-defunct sports arenas and stadiums. There is a growing market for the seats from sporting venues, both as nostalgia items, and as a way to recreate the experience of being at a particular venue or event. The present invention advantageously combines this growing interest in sports venue seats with the existing demand for sports memorabilia in general, by providing an attractive, durable, and easily-constructed sports memorabilia display which provides the look and feel of being at an actual sports venue.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
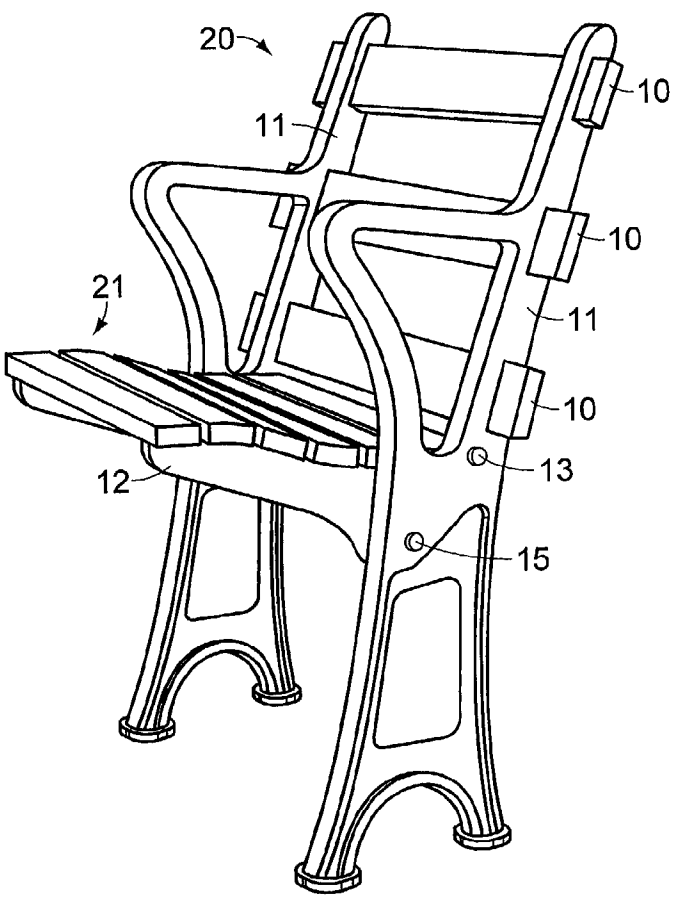
FIG. 1 is a front perspective view of a sports memorabilia display in accordance with one aspect of the invention.

FIG. 1 is a front perspective view of a sports memorabilia display 20 in accordance with one aspect of the invention. The display 20 generally includes one or more substantially vertical supports 11 which are configured to provide mechanical stability to the display when it rests on a relatively flat surface. As shown here, a pair of generally vertical supports 11 are each secured to opposite sides of shelf member 21, and maintain the shelf at a raised elevation. In a preferred embodiment, shelf member 21 is secured to the vertical supports via rivets 15, which permit the shelf to pivot from a generally horizontal position to an upright position. Shelf stop 13 prevents the shelf from pivoting below the horizontal.

The display can additionally include one or more back supports 10. As shown in FIG. 1, for example, the back supports 10 comprise spaced-apart rectangular slats which extend between the upper portion of the two vertical supports 11 above the generally horizontal shelf 21.

Figure 2:
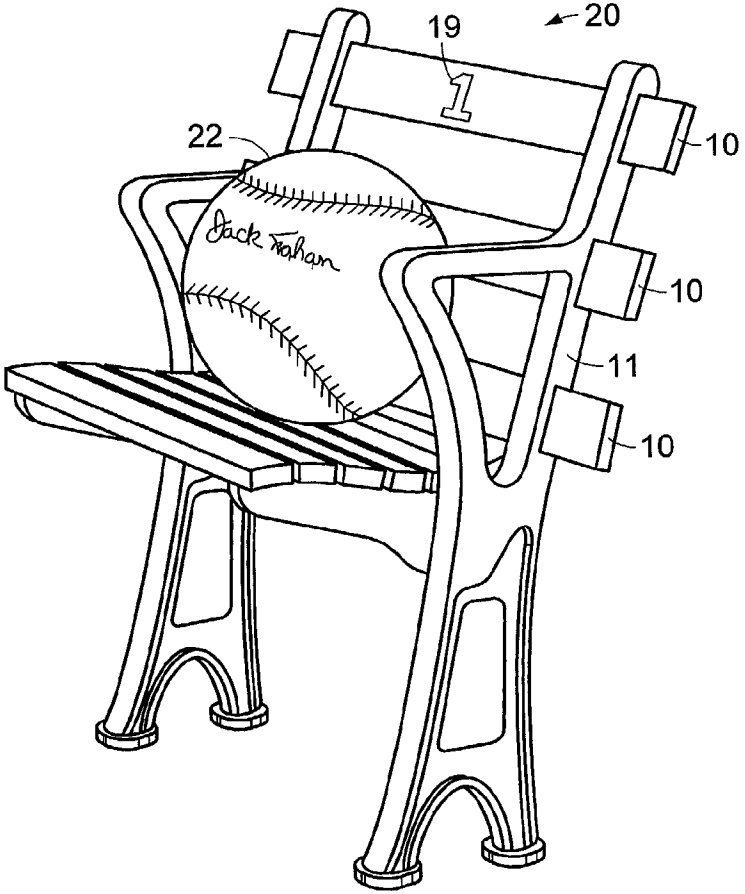
FIG. 2 is a front perspective view of the sports memorabilia display of FIG. 1 supporting an article of sports memorabilia.

In general, the display 20 is adapted to receive object, such as a sports memorabilia item. As shown in FIG. 2, an item of sports memorabilia, specifically an autographed baseball 22, is supported on shelf member 21. The baseball rests on the shelf within an area bounded on two sides by the vertical supports 11, and on a third (rear) side by the back supports 10. It is evident from this drawing that the display 20 is, in effect, a replica of a seat taken from a sports stadium or arena, albeit at a reduced scale to securely hold the baseball 22.

Figure 3:
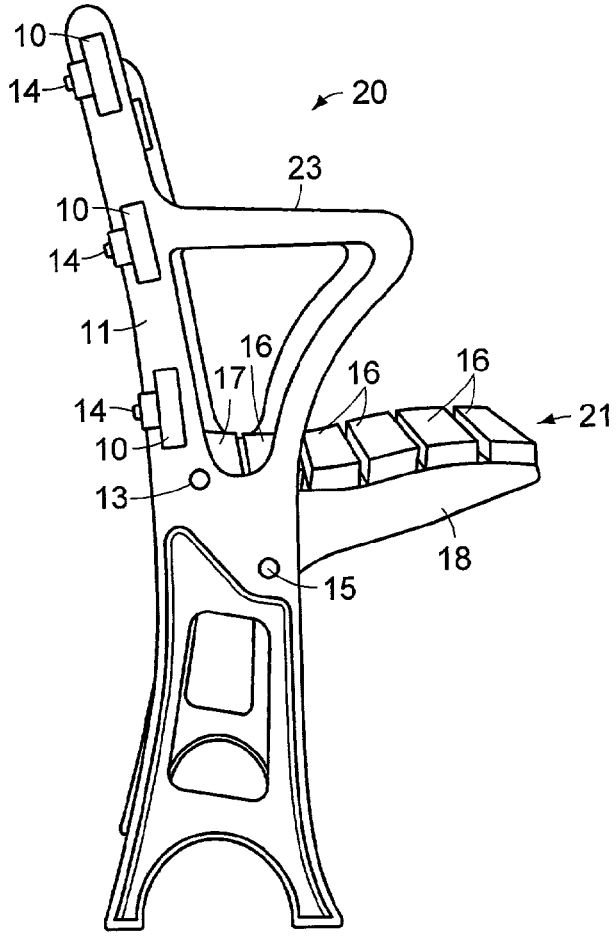
FIG. 3 is a left-side elevational view of the display of FIG. 1.

FIG. 3 is a left-side elevational view of the display 20 of FIGS. 1 and 2. As shown here, the vertical supports 11 comprise a frame structure that is preferably made from a strong and durable material, such as cast-iron. It will be understood, however, that other materials could be employed, such as molded plastic. The vertical support frame is generally wide at the bottom to provide good mechanical stability for the display. Means are provided to secure the vertical frame to the shelf, such as providing a hole for receiving rivet 15, as illustrated in FIG. 3. Also, means may be provided for including a shelf stop 13, which can be formed as an integral component of the vertical support frame.

The upper portion of the vertical support 11 includes a region extending upwards in a generally perpendicular direction relative to the surface of the horizontal shelf 21. This region can be formed with openings for receiving the rectangular slats of the back supports 10, which are secured to the vertiacal frame by back support fasteners 14. According to one aspect, the frame can also be configured to include a region resembling the arm-rest of a chair, such as the railing structure 23 extending above the side of the horizontal shelf shown in FIG. 3.

The shelf member 21 shown in FIG. 3 includes left shelf support 18 and right shelf support 12 (not shown), each shelf support secured to a corresponding vertical support 11, and a plurality of shelf slats 16 extending between the shelf supports. The shelf slats 16 are generally uniformly sized. However, as shown here, one of the shelf slats 17 can be made slightly shorter than the rest to accommodate the shelf stop 13.

Figure 4:
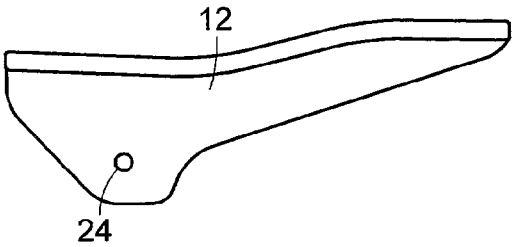
FIG. 4 is a left-side elevational view of a right shelf support in accordance with one aspect of the invention.
Figure 5:
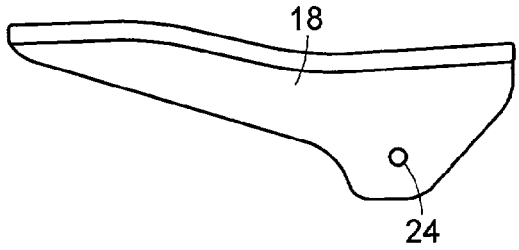
FIG. 5 is a right-side elevational view of the left shelf support in accordance with one aspect of the invention.

A shelf member 21 is described in greater detail in connection with FIGS. 4-7. FIG. 4 is a left-side elevational view of the right shelf support 12. FIG. 5 is a right-side elevational view of the left shelf support 18. The shelf supports can include means for securing the shelf member to the vertical support, such as the holes 24 shown here, which are used to receive a rivet or other fastener. Also as shown, the top surfaces of the shelf supports can be beveled to more accurately resemble the contoured shape of the seats in many sporting venues. This beveled seat design advantageously allows a sports memorabilia item, such as a round ball, to more stably rest between the inclined slope of the contoured seat, and the back support of the display.

Figure 6:
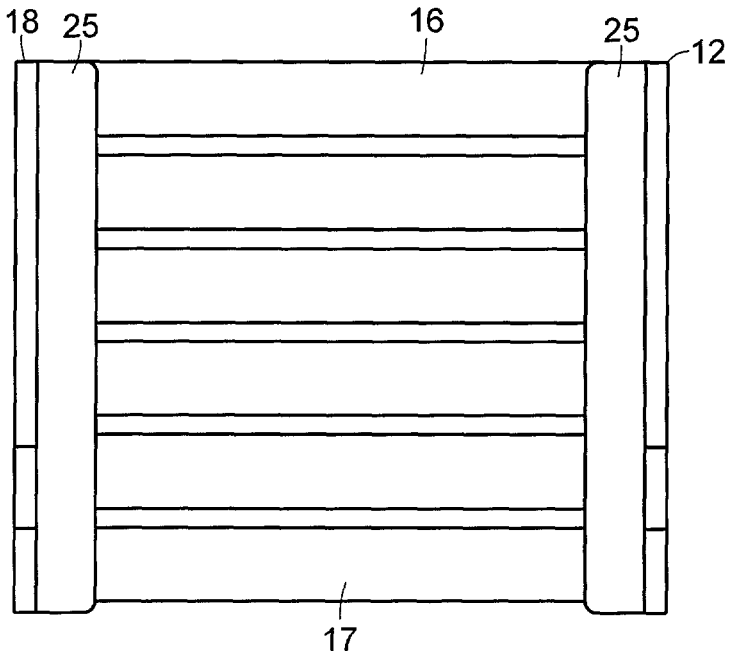
FIG. 6 is a bottom view of a shelf member in accordance with the invention.

FIG. 6 depicts the bottom of shelf member 21, including left and right side shelf supports 12, 18, and slats 16, 17 extending between the shelf supports. As this figure illustrates, the shelf supports 12, 18 include regions 25 extending inwards from the edges of the shelf member 21 to increase the area over which the side supports are in contact with each of the slats. The slats are secured to the shelf supports by, for example, applying a suitable adhesive over this contact area, such as VHB™ (Very High Bond) tape manufactured by 3M Corp. of St. Paul, Minn. Other means may be employed to secure the slats, such as driving a nail or screw through the shelf support and into the slat.

Figure 7:
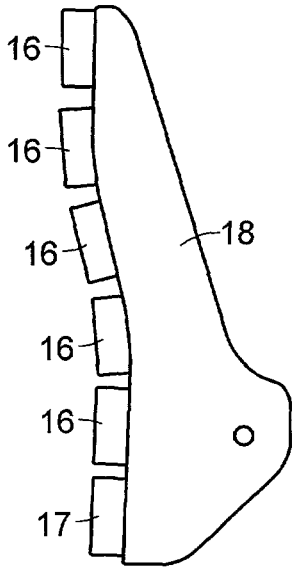
FIG. 7 is a left-side view of a shelf member in an upright position.

FIG. 7 shows a left side view of a finished shelf member 21 in an upright position. As seen here, the slats 16 follow the beveled curves of the side support 18, which gives the surface of the shelf 21 an attractive contoured shape, and can make the display more accurately resemble a seat from a sporting venue. The bottom slat 17 is made slightly shorter than the other slats to accommodate the shelf stop mechanism, as described in greater detail below.

Figure 8:
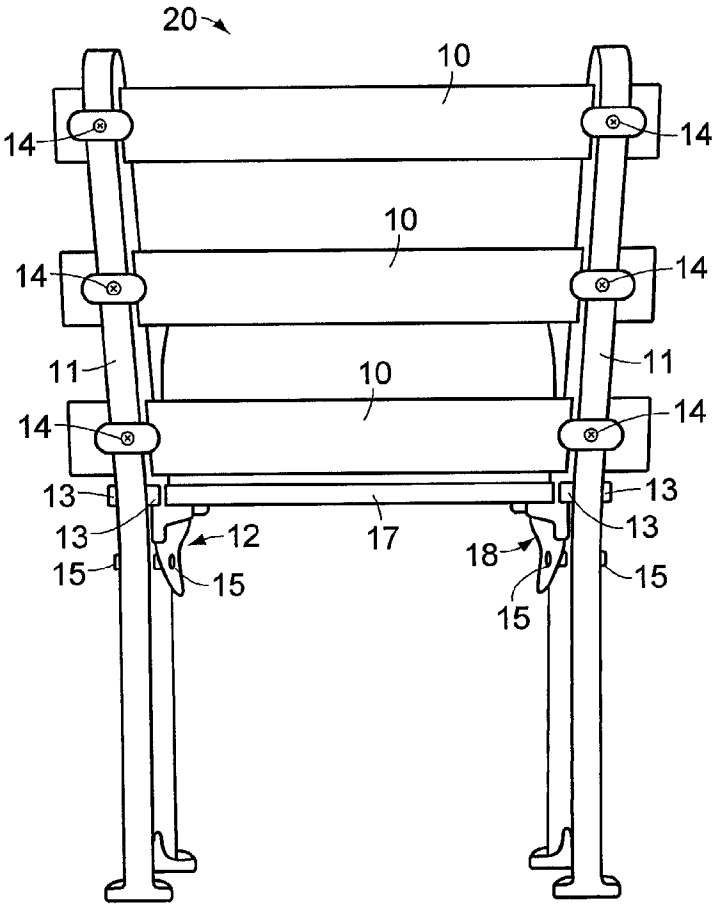
FIG. 8 is a back-side view of the display of FIG. 1.

Turning now to FIG. 8, the back side of the display 20 of FIG. 1 is shown. As shown here, the slightly shortened rear slat 17 of the shelf is secured to left and right shelf supports 12, 18. The two shelf stops 13 extend laterally inwards from the vertical supports 11, and are adjacent to the abbreviated edges of the rear slat 17. The shelf stops 13 also contact the shelf supports 12, 18, and prevent the shelf from pivoting lower than the horizontal level.

Also illustrated in FIG. 8 is rivet 15, which secures the vertical supports 11 to each of the respective shelf supports 12, 18. The rivet additionally allows the entire shelf member to pivotally rotate from the horizontal position, shown here, to a substantially upright position.

Fasteners 14 secure the vertical supports 11 to each of the back supports 10. The fasteners can be small screws, as shown here. Other fastening means, such as a clip, nail, or an adhesive, could be used for this purpose.

Figure 9:
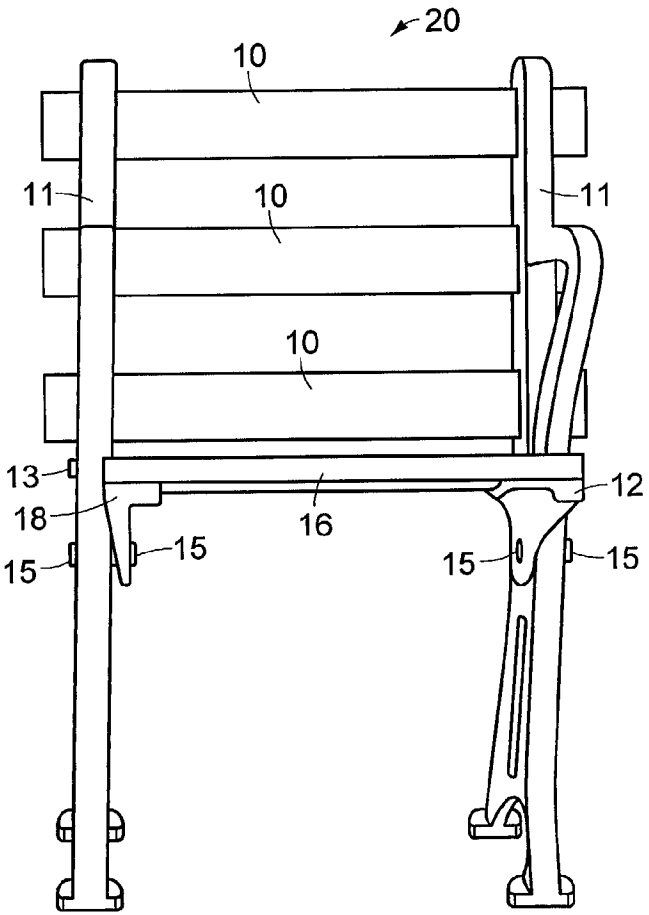
FIG. 9 is a front-side view of the display of FIG. 1.

FIG. 9 shows a front view of this same display 20. Here, the rivets 15 are shown securing the shelf supports 12, 18 to each of the vertical supports 11. A washer can be disposed between the shelf supports and the vertical support to reduce stress, and to facilitate the pivoting movement of the shelf.

It will be understood that alternative structures and designs may be used for displaying an object of sports memorabilia in accordance with the principles of the present invention. In general, the display device is configured to resemble a seat from a sports venue at a substantially reduced scale. The display device shown in FIGS. 1-9, for example, is a miniature replica of a spectator seat from Fenway Park in Boston, Mass. As shown in FIG. 2, the display is generally scaled to receive an item of sports memorabilia, such as a baseball. The shelf member 21 of the display is preferably sized so that the object to be displayed fits comfortably upon the top surface of the shelf. The remaining components of the display, such as the vertical supports 11, and the back supports 10, are scaled accordingly so that the device as a whole resembles a stadium seat. In the baseball display shown here, for example, the baseball sits securely on the shelf, which has a width approximately equal to the diameter of the ball, and the entire display is approximately 9 inches in height. For a larger object, such as a basketball or a football, the display can be made proportionately larger. For a smaller object, such as a golf ball or a hockey puck, the display can be at a smaller scale.

The materials selected for constructing the display can make the display more accurately resemble a seat from a particular sporting venue. For example, most baseball stadiums built in the first half of the twentieth century include seats having a pair of spaced-apart cast-iron frames, which support the seat and back portions of the chair, and additionally serve as arm-rests for the spectator. The seat and back portions of the chair are generally made of wooden slats that extend between the two cast-iron support frames. The seat of the chair is generally permitted to pivot from a substantially horizontal position to an upright position when the chair is not in use.

Accordingly, the display device of the present invention can be constructed of materials that are similar or identical to the materials used for the stadium seat for which the display is configured to resemble. In the example of the Fenway Park replica chair shown in FIGS. 1-9, for instance, the vertical supports 11 and shelf supports 12, 18 are preferably made of cast-iron, while the slats 16, 17 of the shelf member 21, which correspond to the seat portion of the chair, and the back support slats 10, which correspond to the chair back, are constructed of wood. However, other materials may also be used for any of the components, including molded plastic.

Furthermore, although each of the components described in connection with the display device of FIGS. 1-9 is shown as an individual component, it will also be understood that many or all of these components could be integrally combined as a single piece. The shelf 21, for instance, could be a single integral component made of molded plastic. The shape of this piece could be made to resemble the shelf supports and slats described above.

Also, the shelf member 21 could be securely fixed to the vertical supports 11 in such a manner as to not allow the shelf to pivotally rotate from a horizontal to a substantially upright position. In other embodiments, the shelf could be secured to the back support 10, rather than the vertical supports 11. Similarly, the back support 10 could be secured to the rear of the shelf member 21, rather than the vertical supports 11.

Moreover, entire display could be fabricated as a single integral unit, made of plastic, wood, metal, or another suitable material.

The display can still more accurately resemble a seat from a particular sporting venue by choosing a color scheme that is selected to match the color scheme of the stadium seat the display is modeled after. In the case of the Fenway Park seat shown in FIGS. 1-9, for example, the shelf 21 and back supports 10 can be painted dark blue, while the vertical supports 11 are painted dark blue and red. Providing an indicia 19 (FIG. 2) on the top back support 10, such as a seat number, a player name, team name, or a team logo, can further add to the accuracy of the reproduction.

In other embodiments, the display can have a color scheme selected to match colors associated with a particular athlete or sports team. The display can then advantageously be used to display an item of memorabilia that is also associated with this same athlete or sports team.

Furthermore, the indicia 19 shown in FIG. 2 could also relate to a particular athlete or sports team. For instance, it could be a player's name or number, the name of a sports team, or a team logo. The display could then be used to display an item of memorabilia associated with this particular indicia 19.

If such a short message or image is used, preferably the display is sized so that the top of the back support 10 is located above the top of the memorabilia 22 that is displayed. That way, both the memorabilia 22 and the indicia 19 are visible at the same time, as shown in FIG. 2.

Figure 10:
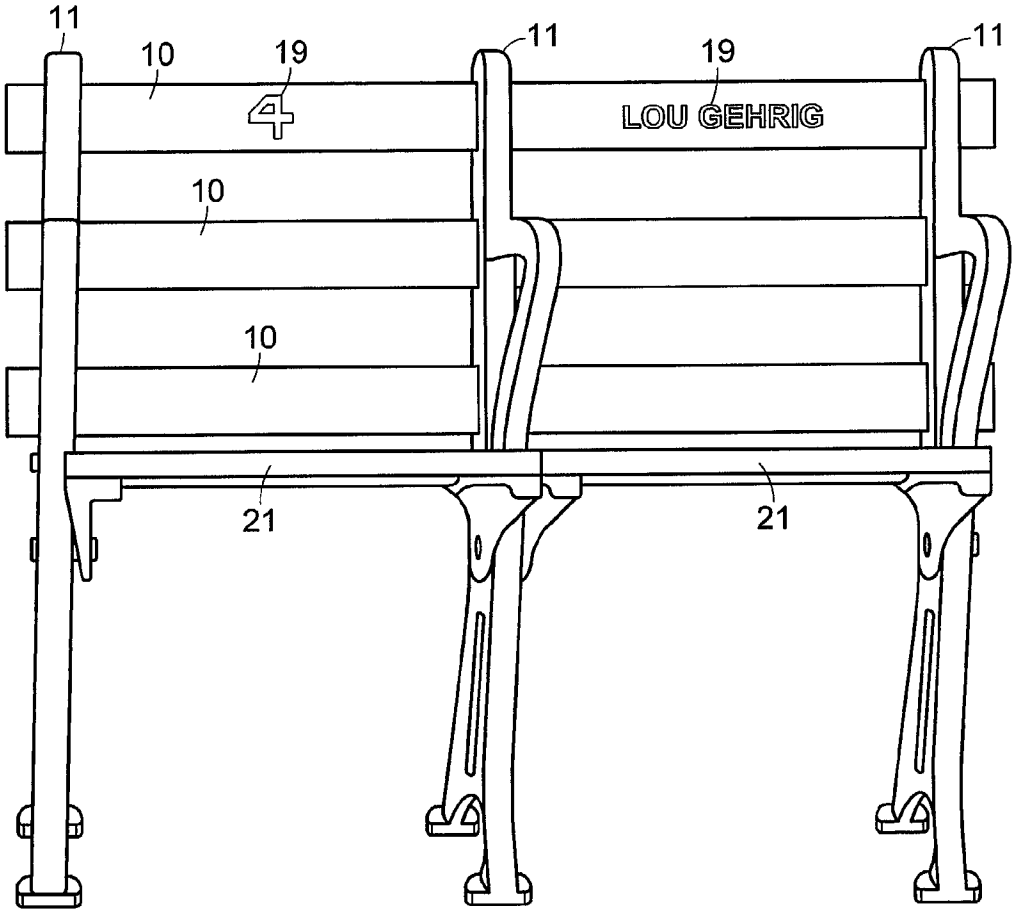
FIG. 10 is a front-side view of a row of two conjoined displays in accordance with the invention.

FIG. 10 illustrates another aspect of the present invention, wherein two or more displays are joined together to form a row of displays, similar to a row of seats as would typically be found in a sporting venue. As in the display of FIGS. 1-9, each of the two displays shown here includes two vertical supports 11, a shelf member 21, and a plurality of back supports 10. In this embodiment, however, the adjacent displays share a common vertical support 11. Also, each back support slat 10 comprises a single piece extending between each of the vertical supports 11 across the entire row of displays.

The two-display row shown in FIG. 10 could be extended to a row having any number of displays. To add another display to the row, a vertical support 11 and shelf member 21 are simply secured to the vertical support 11 at the end of the row to form a new display, substantially as described above. Back support slats 10, cut to the length of the added-on display can then be inserted between the two vertical supports 11, and fastened thereto. Alternatively, the existing slats from the entire row of displays can be removed, and replaced with longer slats sufficient to extend across the new length of the row.

According to one aspect, a plurality of substantially uniform vertical supports and shelf members can be pre-fabricated. A plurality of back support slats can also be pre-fabricated, the back support slats having a number of different lengths, wherein each length corresponds to a different number of conjoined displays. The pre-fabricated vertical supports and shelf members can then be assembled into a row having a selected number of conjoined displays, as described above in connection with FIG. 10. A back slat having a length corresponding to the selected number of conjoined displays can then be inserted across each of the vertical supports in the row, and fastened thereto, to complete the row of displays.

Figure 11:
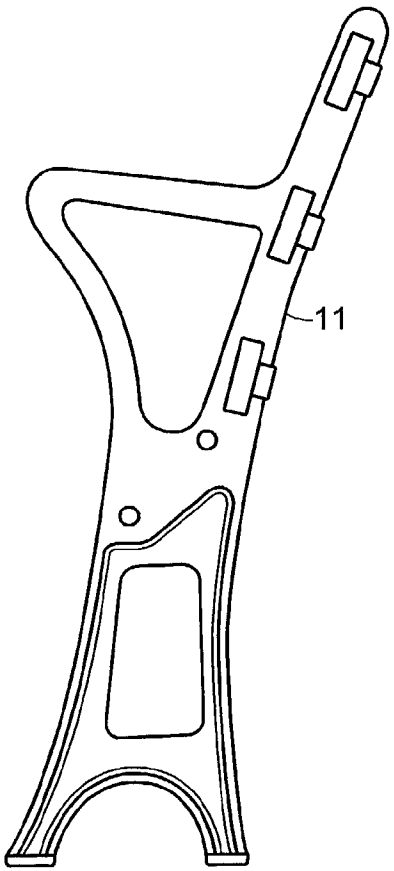
FIG. 11 is a right-side view of the vertical support shown in the display of FIG. 1.

Turning now to FIGS. 11-15, a number of different designs for the vertical supports of the present invention are shown. Each of these supports is configured to resemble a support frame from an actual stadium seat from at least one existing or previously-existing sports venue. FIG. 11, for instance, is the vertical support for the display shown in FIGS. 1-9, and is a replica of the seat frames found in Fenway Park in Boston, Mass., Municipal Stadium in Cleveland, Ohio, and Yankee Stadium in New York, N.Y., among other professional sports stadiums.

Figure 12:
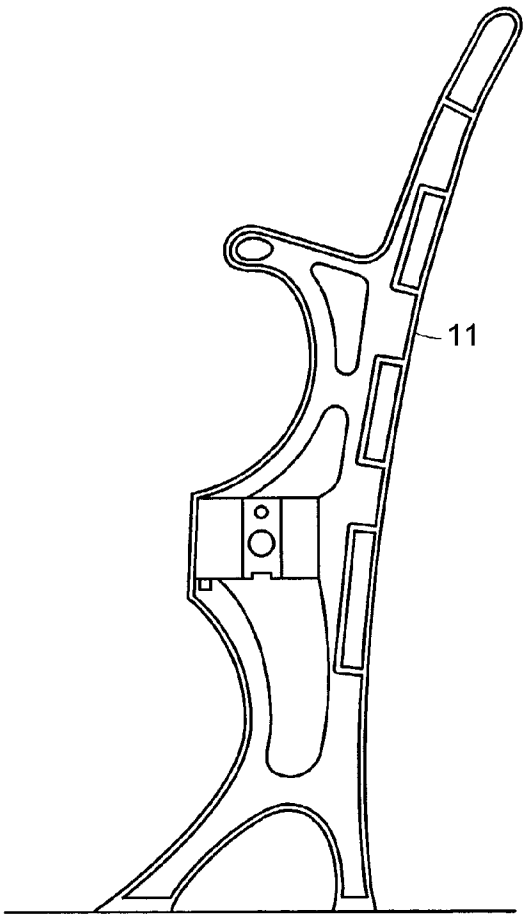
FIG. 12 is a right-side view of a vertical support having an alternative design to the vertical support of FIG. 1.

FIG. 12 shows an alternative design for the vertical supports, where this design resembles the seat frame used for seats at Ebbets Field in Brooklyn, N.Y., Wrigley Field in Chicago, Ill., Crosley Field in Cincinnati, Ohio, and Forbes Field in Pittsburgh, Pa.

Figure 13:
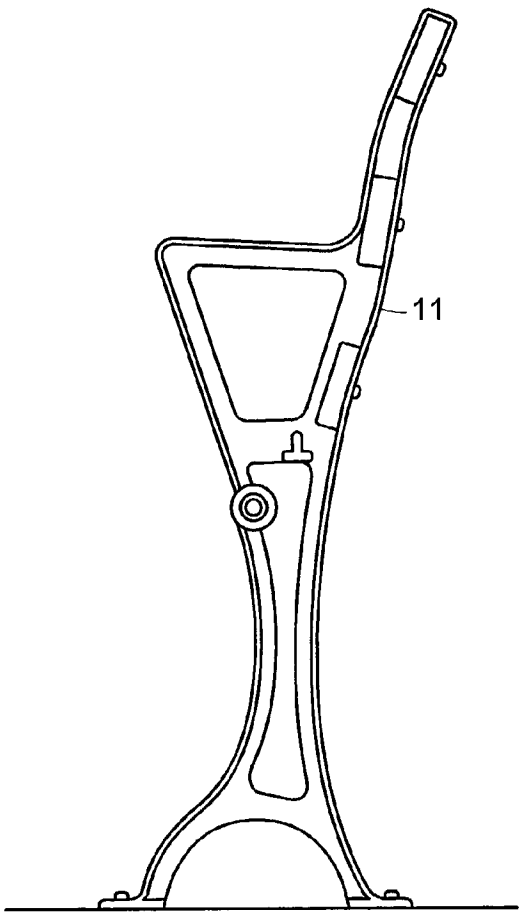
FIG. 13 is a right-side view of a vertical support having yet another alternative design.

FIG. 13 shows yet another vertical support that is designed to resemble the seat frame for seats at Sportsman's Park in St. Louis, Mo.

Figure 14:
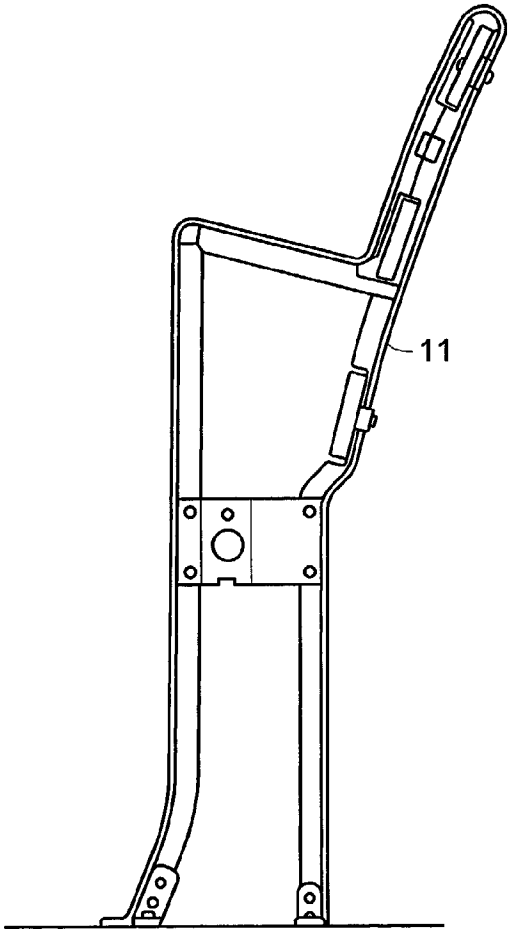
FIG. 14 is a right-side view of a vertical support having yet another alternative design.

FIG. 14 shows still another vertical support that is designed to resemble the seat frame for seats at Tiger Stadium in Detroit, Mich., (old) Comiskey Park in Chicago, Ill., Municipal Stadium in Kansas City, Mo., League Park in Cleveland, Ohio, and Braves Field in Boston, Mass.

Figure 15:
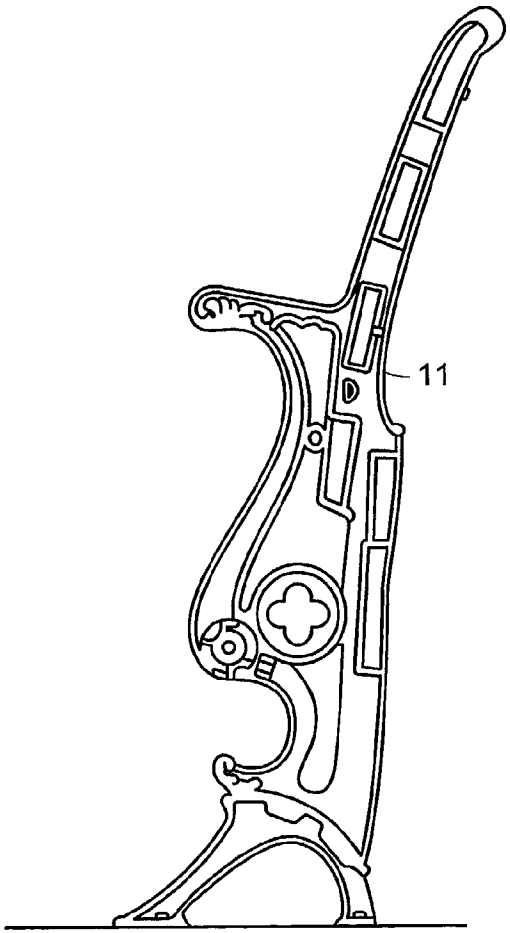
FIG. 15 is a right-side view of a vertical support having yet another alternative design.

Finally, FIG. 15 illustrates a design for a vertical support that resembles the seat frame for seats from the old Forbes Field in Pittsburgh, Pa., and the Baker Bowl in Philadelphia, Pa.

According to another aspect of the invention, a plurality of vertical supports having a variety of designs can be pre-fabricated, where each design resembles the stadium seat support from at least one sports stadium. A plurality of substantially identical shelf members and back supports can also be pre-fabricated. A display can be assembled by selecting a pair of vertical supports resembling the supports from a particular sports stadium, and securing a shelf member and at least one back support to the vertical supports to produce a display which resembles a stadium seat from the chosen sports stadium. According to this embodiment, the shelf members and/or the back supports are designed to be interchangeable between at least two of the vertical support designs. The assembled display device can be a unitary display, as shown in FIGS. 1-9, or can be a row of conjoined displays, as shown in FIG. 10. The finished display can be made to more closely resemble a stadium seat from the particular sports venue by painting the display in the same colors as the seats from the chosen stadium.

Figure 16:
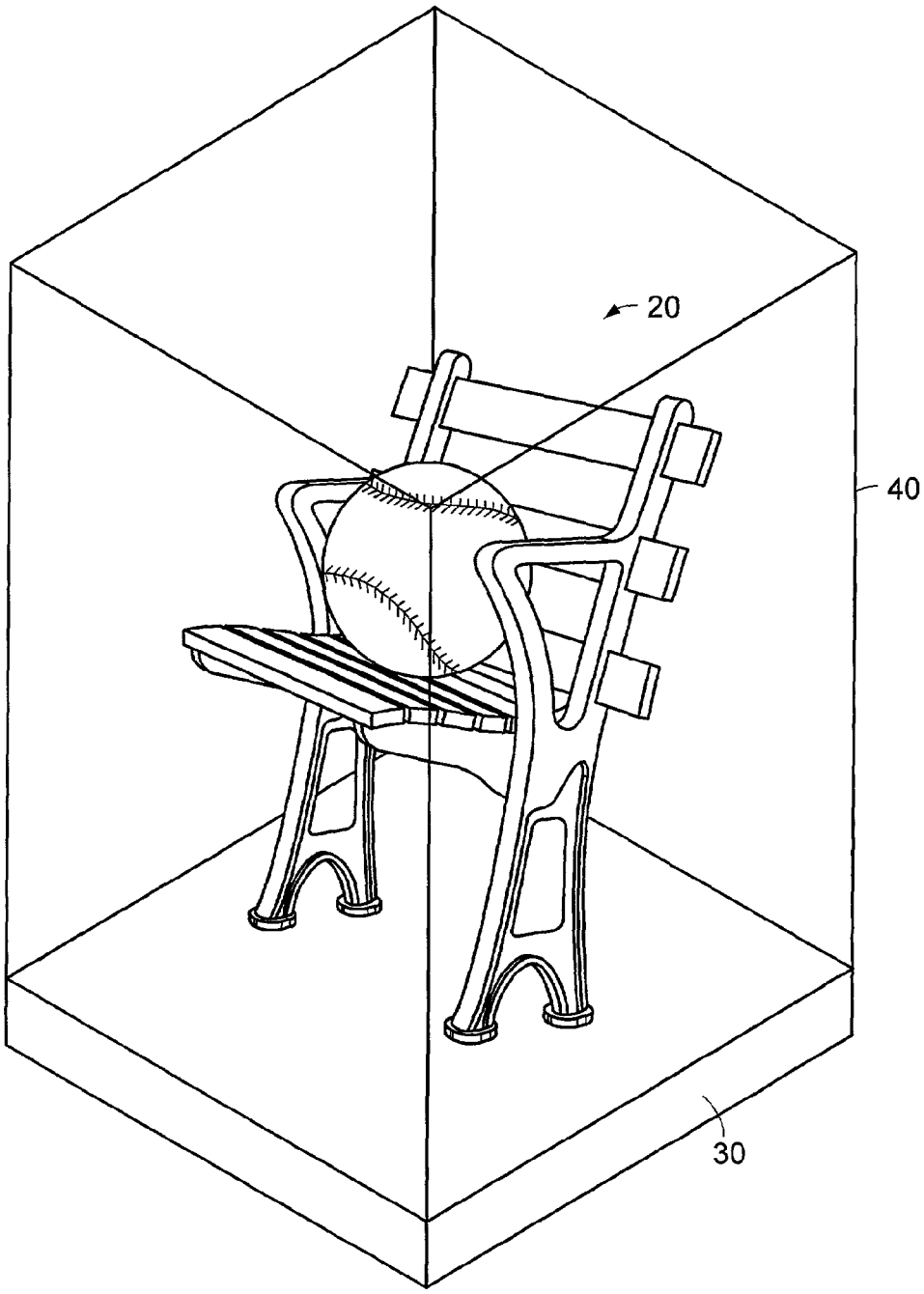
FIG. 16 illustrates a display enclosed by a substantially transparent case, in accordance with an aspect of the invention.

Turning now to FIG. 16, a display 20 in accordance with the present invention is shown on a stand 30. The display can be placed on the stand, and can be optionally secured to the stand via a nail or screw, or with a suitable adhesive. A generally transparent case 40, such as a glass or plastic case, is placed over the display 20, and rests on or over stand 30. The transparent case protects the sports memorabilia item from environmental conditions, while still allowing the item and display case to be clearly seen.

Figure 17B:
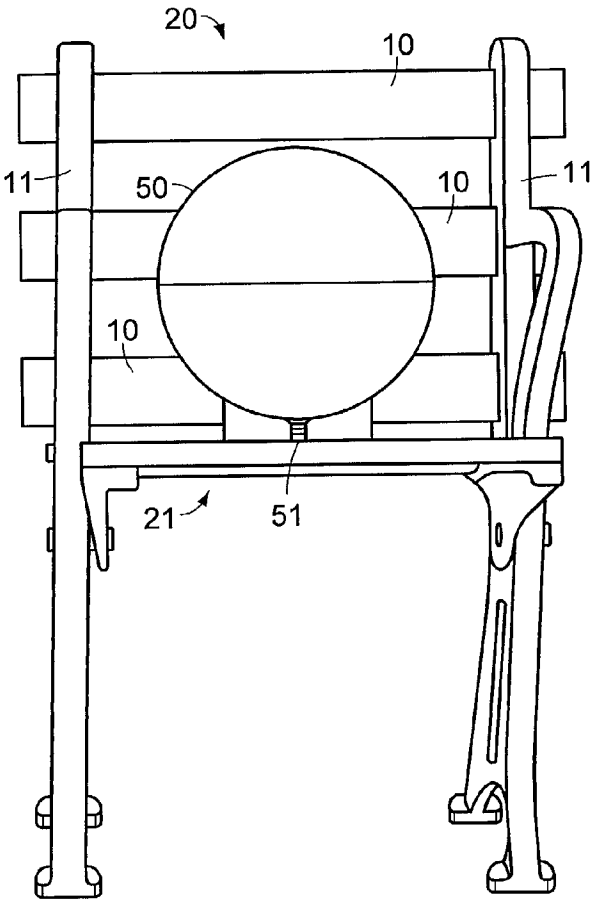
FIG. 17B is a front view of the display of FIG. 17A.
Figure 17A:
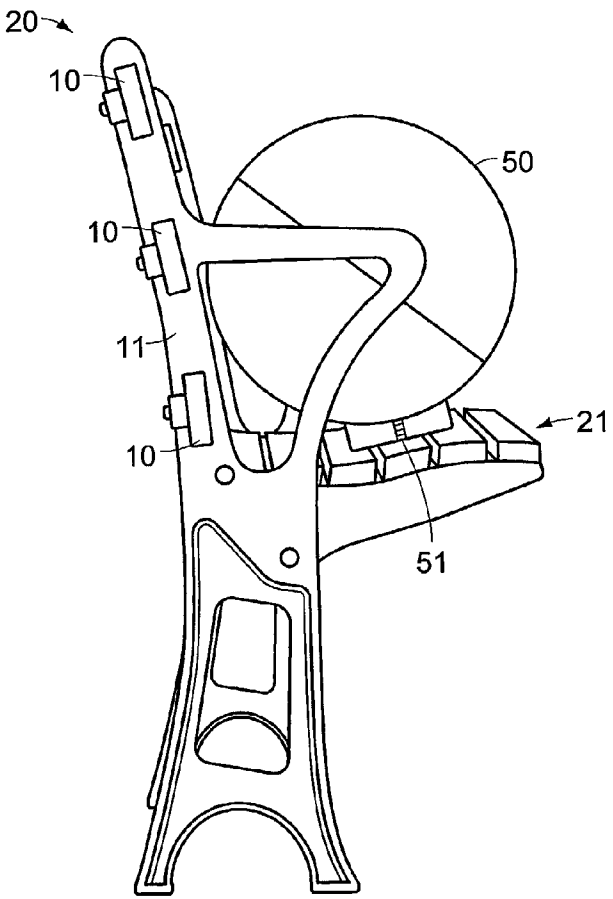
FIG. 17A is a side-view of a display having a generally transparent case for holding an item of sports memorabilia supported on the display.

In yet another embodiment, a generally transparent case for holding the item of sports memorabilia can be supported on the display. As shown in the side view of FIG. 17A, and the front view of FIG. 17B, for example, the case 50 is secured to the shelf member 21 of the display 20. In other embodiments, the case 50 could also be secured to the vertical supports 11, or to the back support 10. Here, the case is spherically shaped for securely holding a baseball, although alternative shapes could also be used. A screw 51 is driven through the bottom of the case 50, into the top side of the shelf member 21. Other means may be employed for securing the case to the shelf, including driving a fastener up through the shelf member 21 into the case, or securing the case 50 to the shelf member using an adhesive substance. It will also be understood that the case need not be secured to the display.

Figure 18:
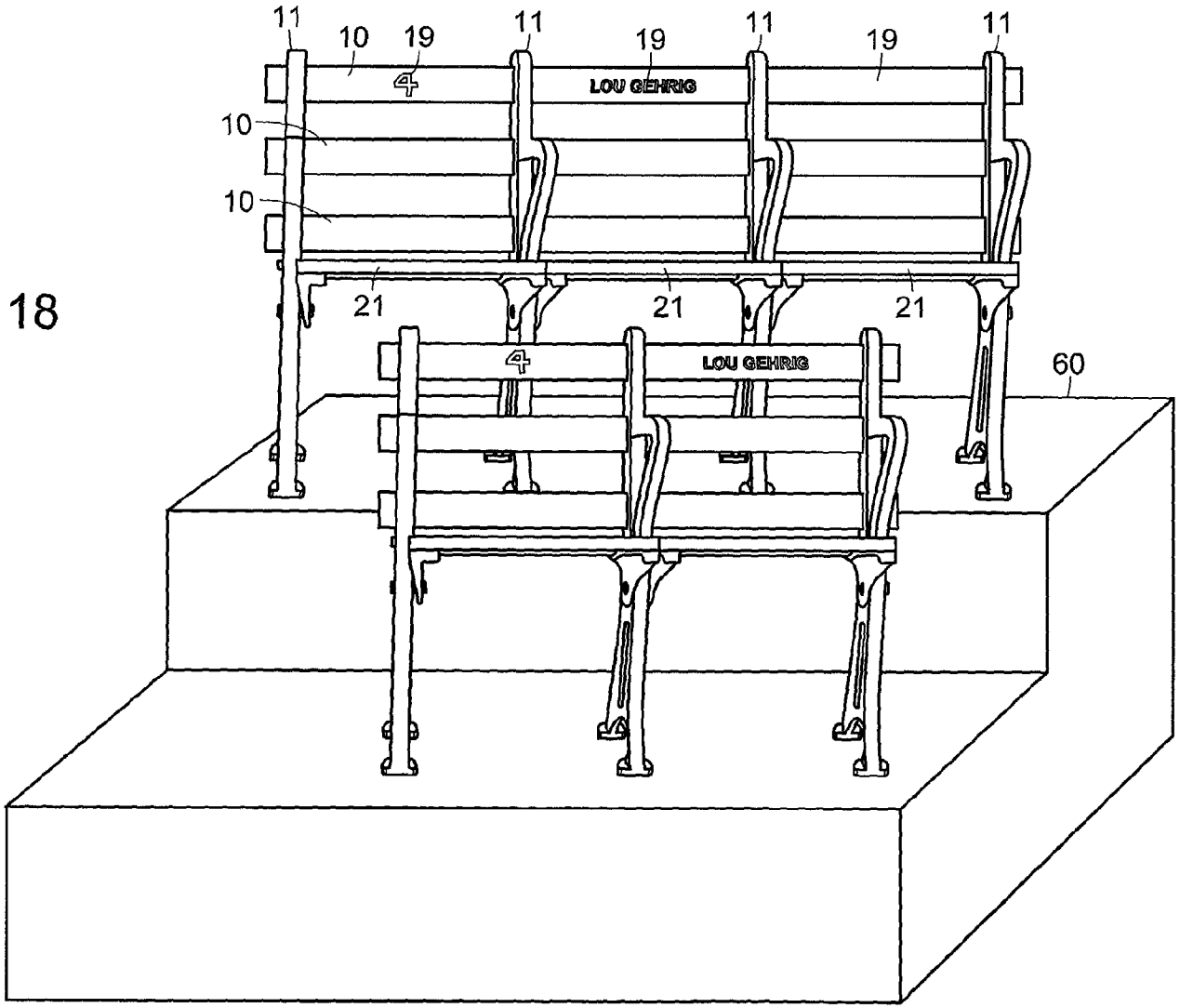
FIG. 18 shows two rows of displays in a vertically tiered configuration.

FIG. 18 shows two rows of displays on a base 60 which supports the rows in a vertically-tiered configuration. This arrangement permits a plurality of sports memorabilia items to be shown at one time in a compact space. The tiered-configuration also resembles the arrangement of rows from a stadium. Preferably, each tier of the base is sufficiently raised in relation to the preceding tier so that each item of memorabilia, and any indicia 19 on the displays, are visible at one time.

While this invention has been particularly shown and described with references to preferred embodiments thereof, it will be understood by those skilled in the art that various changes in form and details may be made therein without departing from the scope of the invention encompassed by the appended claims.

What is claimed is:

1. A display for an article of sports memorabilia, comprising:

a generally horizontal shelf member for receiving an article of sports memorabilia; support means for supporting the shelf member at a raised elevation, the display being configured to resemble a seat from a sports venue at a substantially reduced scale, the support means comprising two generally vertical supports are located adjacent to opposite edges of the generally horizontal shelf member, and are secured to the shelf member; and a substantially transparent case located above the top surface of the generally horizontal shelf member for enclosing an article of sports memorabilia.

2. A display for an article of sports memorabilia, comprising:

a generally horizontal shelf member for receiving an article of sports memorabilia;

support means for supporting the shelf member at a raised elevation, the display being configured to resemble a seat from a sports venue at a substantially reduced scale;

a holder above the top surface of the shelf member, the holder comprising a substantially transparent case located above the top surface of the generally horizontal shelf member for enclosing an article of sports memorabilia; and an article of sports memorabilia on the holder.

3. The display of claim 1 additionally comprising a back support member located above an edge of the shelf member and extending generally perpendicular to the substantially horizontal shelf member.

4. The display of claim 3 wherein the substantially transparent case is secured to at least one of the shelf member and back support member.

* * * * *